United States Patent [19]

Anderson

[11] 4,120,357

[45] Oct. 17, 1978

[54] METHOD AND APPARATUS FOR RECOVERING VISCOUS PETROLEUM FROM THICK TAR SAND

[75] Inventor: Donald J. Anderson, Newport Beach, Calif.

[73] Assignee: Chevron Research Company, San Francisco, Calif.

[21] Appl. No.: 840,689

[22] Filed: Oct. 11, 1977

[51] Int. Cl.[2] ..... E21B 43/24

[52] U.S. Cl. ..... 166/272; 166/245; 166/52; 166/57

[58] Field of Search ..... 166/272, 302, 303, 57, 166/61, 52, 314, 245, 263

[56] References Cited

U.S. PATENT DOCUMENTS

| | | | |
|---|---|---|---|
| 2,841,375 | 7/1958 | Salomonsson | 166/245 |
| 3,007,521 | 11/1961 | Trantham et al. | 166/245 |
| 3,412,794 | 11/1968 | Craighead | 166/272 |
| 3,472,318 | 10/1969 | Woodward | 166/245 |
| 3,493,050 | 2/1970 | Kelley et al. | 166/302 X |
| 3,608,638 | 9/1971 | Terwilliger | 166/272 |
| 3,908,763 | 9/1975 | Chapman | 166/302 |
| 3,994,340 | 11/1976 | Anderson et al. | 166/272 |
| 3,994,341 | 11/1976 | Anderson et al. | 166/272 |
| 4,008,765 | 2/1977 | Anderson et al. | 166/272 |

*Primary Examiner*—Stephen J. Novosad

*Attorney, Agent, or Firm*—R. L. Freeland, Jr.; Edward J. Keeling

[57] ABSTRACT

Recovery of viscous petroleum such as from a thick tar sand formation is assisted using a closed-loop flow path formed in a production well extending from the earth's surface through a substantial portion of the formation for conducting hot fluid to reduce the viscosity of the petroleum in the formation to develop a first potential passage in the formation outside the flow path into which a hot drive fluid is injected through a injection well to promote movement of the petroleum to the production well for production and to develop a second potential passage for fluid flow in the formation from a linearly spaced apart injection well for injection of a hot drive fluid to further promote movement of additional petroleum to the production well.

8 Claims, 5 Drawing Figures

METHOD AND APPARATUS FOR RECOVERING VISCOUS PETROLEUM FROM THICK TAR SAND

FIELD OF THE INVENTION

The invention relates to recovering viscous petroleum from petroleum-containing reservoirs.

BACKGROUND OF THE INVENTION

This invention relates generally to recovering viscous petroleum from petroleum-containing formations. Throughout the world there are several major deposits of high-viscosity crude petroleum in oil sands not recoverable in their natural state through a well by ordinary production methods. In the United States, the major concentration of such deposits is in Utah, where approximately 26 billion barrels of in-place heavy oil or tar exists. In California, the estimate of in-place heavy oil or viscous crude is 220 million barrels. By far the largest deposits in the world are in the Province of Alberta, Canada, and represent a total in-place resource of almost 1000 billion barrels. The depths range from surface outcroppings to about 2000 feet.

To date, none of these deposits has been produced commercially by an in-situ technology. Only one commercial mining operation exists, and that is in a shallow Athabasca deposit. A second mining project is about 75% completed at the present time. However, there have been many in-situ well-to-well pilots, all of which used some form of thermal recovery after establishing communication between injector and producer. Normally such communication has been established by introducing a pancake fracture. The displacing or drive mechanism has been steam and combustion, such as the project as Gregoire Lake or steam and chemicals such as the early work on Lease 13 of the Athabasca deposit. Another means of developing communication is that proposed for the Peace River project. It is expected to develop well-to-well communication by injecting steam over a period of several years into an acquifer underlying the tar sand deposit at a depth of around 1800 feet. Probably the most active in-situ pilot in the oil sands has been that at Cold Lake. This project uses the huff-and-puff single-well method of steam stimulation and has been producing about 4000 barrels of viscous petroleum per day for several years from about 50 wells. This is probably a semi-commercial process, but whether it is a paying proposition is unknown.

The most difficult problem in any in-situ well-to-well viscous petroleum project is establishing and maintaining communication between injector and producer. In shallow deposits, fracturing to the surface has occurred in a number of pilots so that satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1,000,000 cp at reservoir temperature.

As noted, the major problem of the economic recovery from many formations has been establishing and maintaining communication between an injection position and a recovery position in the viscous oil-containing formation. This is primarily due to the character of the formations, where effective mobility of fluids may be extremely low, and in some cases, such as the Athabasca Tar Sands, virtually nil. Thus, the Athabasca Tar Sands, for example, are strip mined where the overburden is limited. In some tar sands, hydraulic fracturing has been used to establish communication between injectors and producers. This has not met with uniform success. A particularly difficult situation develops in the intermediate overburden depths, which cannot stand fracturing pressure.

PRIOR ART

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been overly successful because of the difficulty of establishing and maintaining communication between the injector and the producer. Clearly, if one could establish and maintain communication between injector and producer, regardless of the drive fluid or recovery technique employed, it would open up many of these viscous petroleum deposits to a number of potentially successful projects.

Methods and systems for developing and maintaining such communication and for recovery of viscous petroleum are set out in the following patents which are assigned to the assignee of this application: U.S. Pat. No. 4,037,658, issued July 26, 1977; U.S. Pat. No. 3,994,340, issued Nov. 30, 1976; U.S. Pat. No. 3,994,341, issued Nov. 30, 1976; U.S. Pat. No. 4,019,575, issued Apr. 26, 1977; U.S. Pat. No. 4,008,765, issued Feb. 22, 1977; and U.S. Pat. No. 4,020,901, issued May 3, 1977.

U.S. Pat. Nos. 4,008,765 and 4,019,575 relate to a method and system for recovering heavy petroleum from a thick tar sand formation utilizing vertical injection and production wells. Thus, a substantially vertical production well is formed through the tar sand-containing formation. A casing string having a production opening near its lower portion is inserted into the production well. A production flow line is extended from a position adjacent the production opening of the casing to the earth's surface and the space between the interior of the casing string and the exterior of the production flow line is packed off. A tubular member is extended into the well between the interior of the casing string and the exterior of the production flow line from the earth's surface to a position above the packoff means to form a closed-loop flow path from the earth's surface to the packoff means and back to the earth's surface. A hot fluid is circulated through the closed-loop flow path to heat the viscous petroleum in the formation adjacent at least a portion of the production well to form a potential passageway for fluid flow through the formation, and a drive fluid is injected through an injection well into the upper portion of the formation near the potential passageway to promote flow of petroleum to the production opening near the bottom of the casing string of the well. These patents, however, are directed to recovering petroleum from a large vertical formation adjacent the production well. They do not provide specifically for recovery from the formation horizontally remote from the production well.

BRIEF DESCRIPTION OF THE INVENTION

The present invention provides for assisting the recovery of viscous petroleum from a large volume of a petroleum-containing formation. A production well is formed through the petroleum-containing formation and a casing string having a production opening near its lower portion is inserted into the production well to provide a production flow line in the production well from a position adjacent the production opening to the earth's surface. A tubular member is inserted into the production well to form a closed-loop flow path from the earth's surface to the lower portion of the formation and back to the earth's surface. A hot fluid is circulated through the closed-loop flow path to heat the viscous petroleum in the formation adjacent at least a portion of the production well to form a first potential passageway for fluid flow through the formation. A plurality of injection wells are linearly spaced apart from the production well and communicate with the upper portion of the formation. The first of the injection wells is positioned for injection of hot drive fluid into the first potential passageway for fluid flow in the formation and the remaining injection wells are linearly spaced apart from the first injection well and each other at least a distance equal to the distance between the production well and the first injection well. A hot drive fluid is injected through the first injection well into the upper portion of the formation into the first potential passageway to promote flow of petroleum to the production opening near the bottom of the casing string of the production well and to form a second potential passageway for fluid flow in the formation communicating with the next adjacent linearly spaced apart injection well. The injection of hot drive fluid through the first injection well is stopped when significant breakthrough of hot drive fluid occurs into the production well. Injection of hot drive fluid through the next adjacent linearly spaced apart injection well and thence into the second potential passageway for fluid flow in formation is started to promote flow of petroleum to the production well. Progressively thereafter, hot drive fluid injection is stopped at a given injection well as significant hot drive fluid breakthrough occurs at the production well and started at the further next adjacent linearly spaced apart injection well.

OBJECT OF THE INVENTION

The principal object of the present invention is to maximize recovery of viscous petroleum from a tar sand wherein communication between a plurality of linearly spaced apart injector positions and a producer position is difficult to establish and maintain by utilizing a hot fluid in a physically separated, substantially vertical flow path through the formation to assist in establishing and maintaining communication for a hot drive fluid used to promote movement of the petroleum to the producer position. Further objects and advantages of the present invention will become apparent when the following description is read in view of the accompanying drawings which are made a part of this specification.

DETAILED DESCRIPTION OF THE EMBODIMENTS OF THE INVENTION

Figure 1:
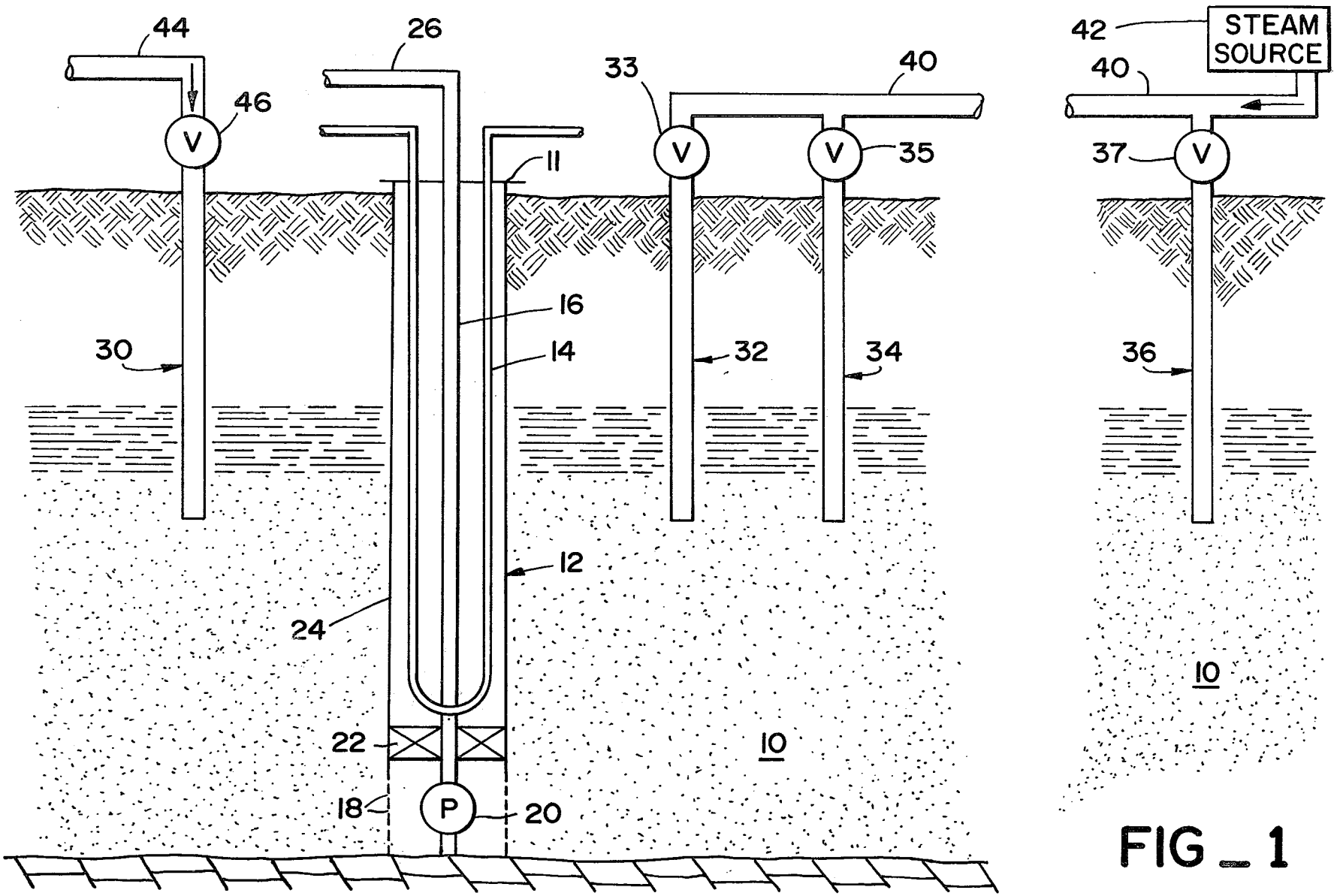
FIG. 1 is an elevation view partially in section and illustrates the preferred system assembled in accordance with the present invention for use in recovering viscous petroleum from an underground formation.

Refer now to the drawings, and to FIG. 1 in particular, where the preferred system assembled in accordance with the invention is illustrated. FIG. 1 shows a substantially vertical passage formed through a petroleum-containing tar sand 10. The vertical passage may be a well, as generally indicated by the number 12, and is cased by means of casing 24. A wellhead 11 is located at the upper end of the casing 24. A hollow tubular member 14 extends through the wellhead 11 to a position near the lower part of the tar sand 10 and returns to the earth's surface to provide a closed loop flow path from the earth's surface to the lower portion of the tar sand formation. The ends of the tubular member 14 are connected in an appropriate manner to a source for circulating a hot fluid in the tubular member.

The casing 24 is provided with slots or perforations 18 to form a production opening near its lower portion into the production well. A production flow line 16 is located in the production well and extends from a position adjacent the production opening 18 to the earth's surface. A packoff means, such as packer 22, is used to packoff the flow line 16 — casing 24 annulus above the production opening 18. A suitable pump, schematically represented by the numeral 20 is used to move petroleum up the production well to the surface production line 26.

A plurality of injection wells 32, 34, and 36 are linearly spaced apart from one side of the production well 12. A second line of wells as illustrated by well 30 may extend from another side of the production well 12. The injection wells penetrate the upper portion of the formation. The injection wells 32, 34 and 36 are provided with a suitable manifold 40 which is connected to a steam source 42. Control valves 33, 35 and 37 control the flow of steam to the injection wells 32, 34 and 36. If a second line of injection wells are provided as exemplified by well 30, they also utilize a connection such as conduit 44 to a steam source. Control is provided by a suitable valve 46.

The first of the injection wells 32 is positioned adjacent the production well 12 for injection of hot drive fluid into the first potential passageway for fluid flow in the formation developed by circulating hot fluid in conduit 14. The remaining injection wells 34 and 36 are linearly spaced apart from the first injection well 32 and each other at least a distance equal to the distance between the production well 12 and the first injection well 32. The distance that the wells are spaced apart is normally measured on a horizontal line and the wells are drilled in a substantially vertical direction. However, the hot fluid injection points are the important locations and, if desired, the wells may be deviated to arrive at a proper horizontal spacing. The actual distance that the first injection well will be spaced apart from the production well will vary depending on many factors including the formation characteristics and the temperature of the hot circulating fluid. Simulator programs may be developed to obtain optimum injector-producer spacing for a particular formation. In some tar sands an injector-producer spacing of 40 to 50 feet would be suitable. The secondary injection wells are then located in an inline configuration spaced at least 40 to 50 feet apart.

In accordance with the invention, a hot fluid such as steam is flowed through the closed-loop flow path 14 to heat the viscous petroleum in tar sand formation 10 to reduce the viscosity of at least a portion of the petroleum adjacent the casing 24. This provides a first potential passage for flow of the hot drive fluid, such as steam from well 32 into the formation. By suitably controlling the flow in the closed-loop flow path and the formation 10, a good sweep efficiency can be obtained and oil recovery maximized through perforations 20 into producing well 12. Thus, when the steam flowing in the flow path establishes injectivity for the drive fluid into the formation and results in some production of petroleum from the production well 12, steam flow through the closed-loop flow path in well 12 is terminated to prevent breakthrough of the drive fluid. If the injectivity of the drive fluid becomes undesirably low, then additional steam is flowed through the closed-loop flow path to reestablish the desired injectivity.

When significant breakthrough of steam occurs into the production well such that production of petroleum from the well is not economic, then steam injection through injection well 32 is stopped. Steam injection is then initiated through the next linearly spaced apart injection well 34 into the second potential passageway for fluid flow into the formation which was developed during and as a result of the initial steam injection into well 32. Steam injection into well 34 is continued until production again becomes undesirably low at the production well 12. Thus, progressively the steam injection is stopped at a given injection well when significant steam breakthrough occurs at the production well and then steam injection is started at the next further linearly spaced apart injection well.

Figure 2A:
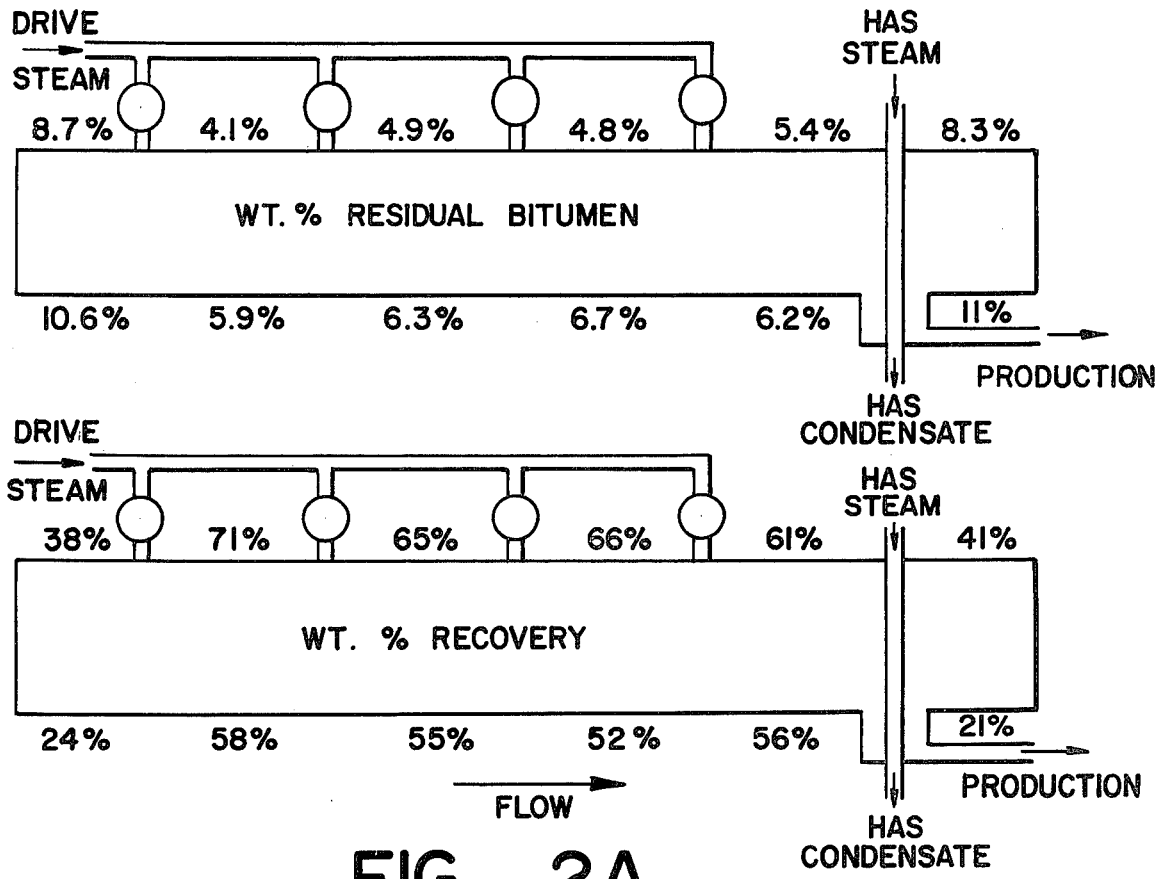
FIG. 2A shows schematic illustrations of a core flood demonstration and gives weight percent residual bitumen and weight percent recovery figures.
Figure 2B:
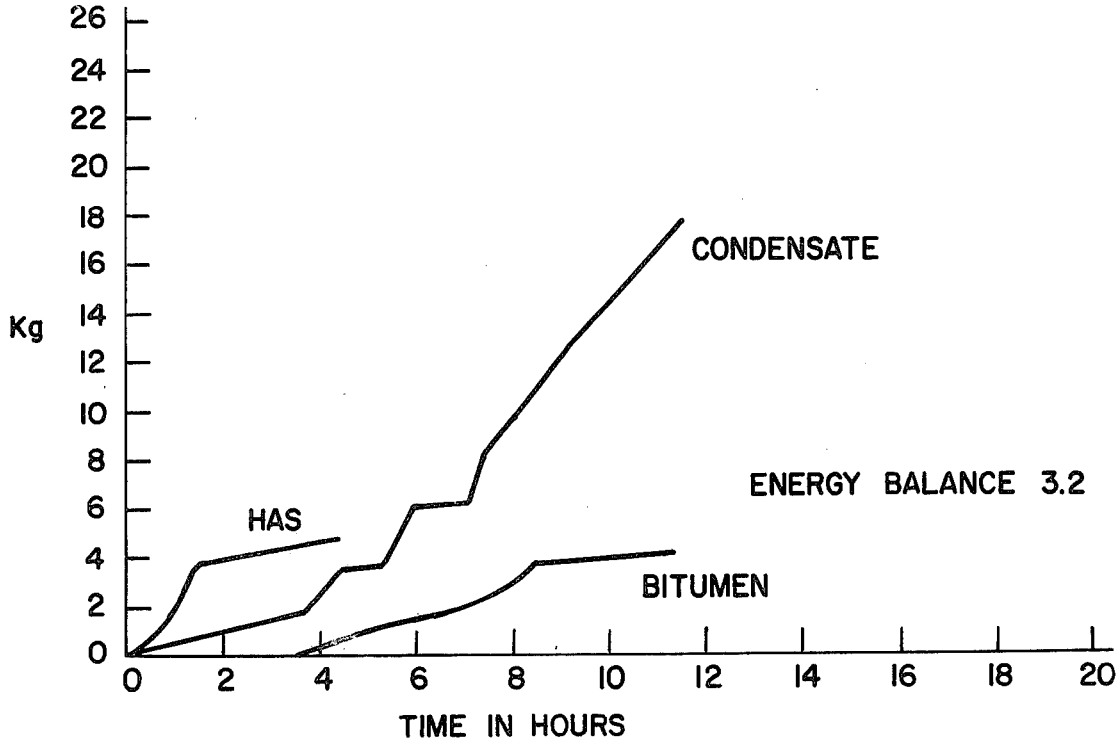
FIG. 2B is a graph containing curves of various data obtained from the core flood of FIG. 2A.
Figure 3A:
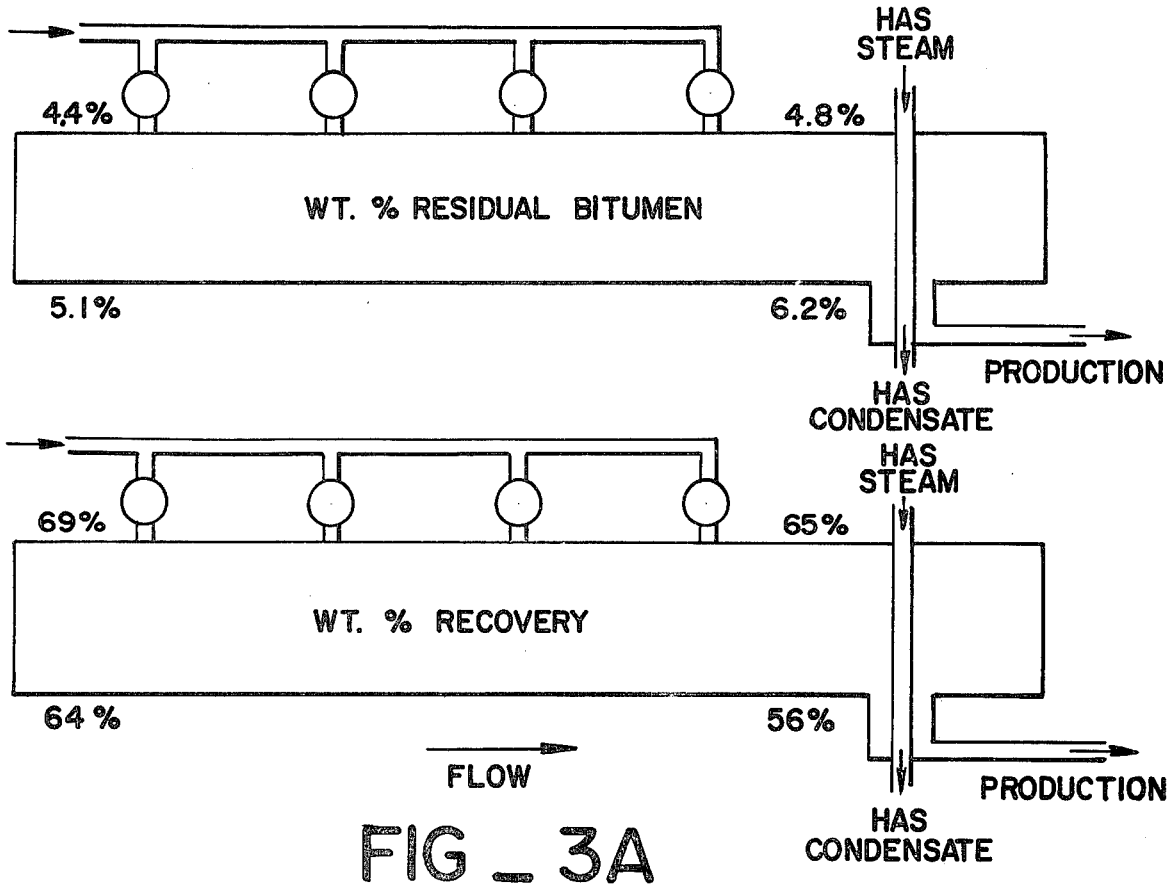
FIG. 3A shows schematic illustrations of a core flood demonstration and gives weight percent residual bitumen and weight percent recovery figures.
Figure 3B:
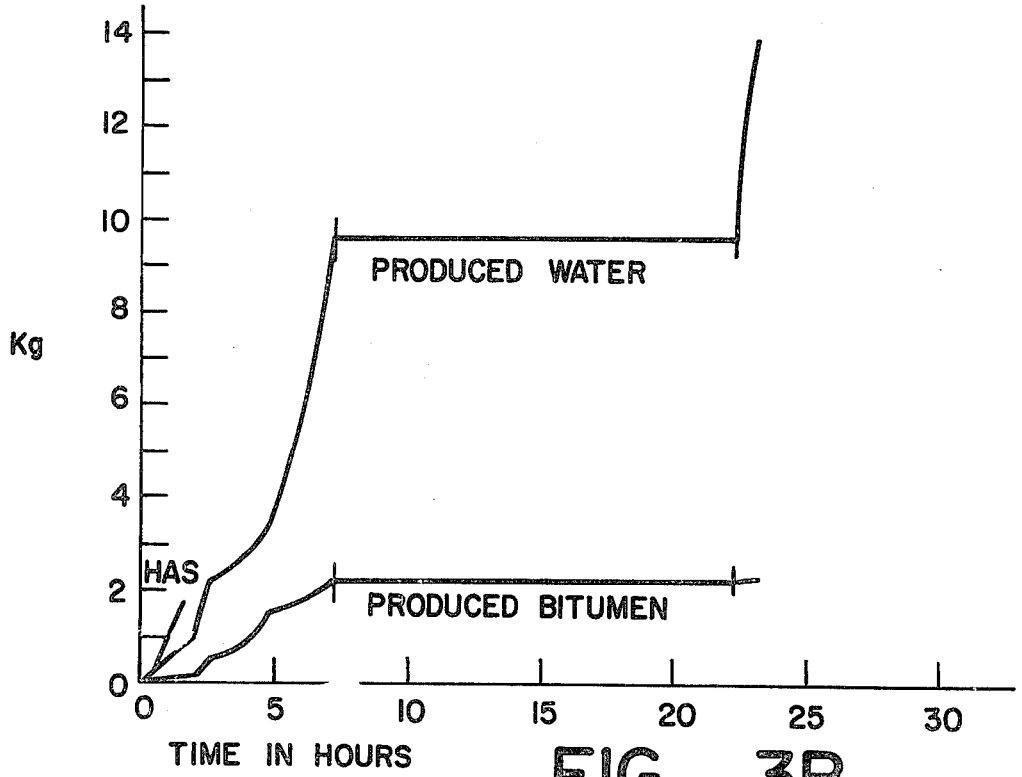
FIG. 3B is a graph containing curves of various data obtained from the core flood of FIG 3A.

FIGS. 2A, 2B, 3A and 3B show the configuration of the apparatus used and results of typical sand pack demonstrations. The apparatus configuration, shown schematically in FIGS. 2A and 3A, used a 5-foot by 6-inch O.D. and a 30-inch-long by 6-inch O.D. pipe respectively arranged with its longer axis horizontal and the steam drive applied at various positions along the upper face of the oil sand pack. The closed flow path for hot fluid (Hot Annulus Steam or HAS) is located at the far right of the apparatus. FIGS. 2A and 3A show the weight percent residual bitumen and the weight percent recovery in two typical demonstrations. In both cases the starting oil sand contained 14 weight percent bitumen. The residual oil recovery values were determined by analyzing the sand pack at points 1 inch below and 1 inch above the top and bottom of the oil sand pack. FIGS. 2B and 3B show plots of typical produced fluids versus time. Production occurred through a vertical annulus created close to same end of the apparatus.

What is claimed is:

1. A method of assisting the recovery of viscous petroleum from a petroleum-containing formation comprising the steps of forming a production well through a petroleum-containing formation, said formation having an initial low potential for fluid injection, inserting a casing string having a production opening near its lower portion into said production well, providing a production flow line in said production well from a position adjacent said production opening to the earth's surface, extending a tubular member into said production well to form a closed-loop flow path from the earth's surface to the lower portion of said formation and back to the earth's surface, circulating a hot fluid through said closed-loop flow path to heat the viscous petroleum in said formation adjacent at least a portion of said production well to form a first potential passageway for fluid flow through said formation, providing a plurality of injection wells linearly spaced apart from said production well and communicating with the upper portion of said formation, the first of said injection wells positioned for injection of hot drive fluid into said first potential passageway for fluid flow in said formation and the remaining injection wells linearly spaced apart from said first injection well and each other at least a distance equal to the distance between said production well and said first injection well, injecting a hot drive fluid through said first injection well into the upper portion of said formation into said first potential passageway to promote flow of petroleum to the production opening near the bottom of said casing string of said production well and to form a second potential passageway for fluid flow in said formation communicating with the next adjacent linearly spaced apart injection well, stopping injection of hot drive fluid through said first injection well when significant breakthrough of hot drive fluid occurs in said production well, starting injection of hot drive fluid through said next adjacent injection well into said second potential passageway for fluid flow in said formation to promote flow of petroleum to said production well and progressively stopping hot drive fluid injection at a given injection well as significant hot drive fluid breakthrough to the said production well occurs and starting hot drive fluid injection at the next further linearly spaced apart injection well.

2. The method of claim 1 where the hot fluid is steam.

3. The method of claim 2 where the hot drive fluid is steam.

4. The method of claim 1 where the hot drive fluid is steam.

5. A system for use in assisting the recovery of viscous petroleum from a petroleum-containing formation comprising a production well extending through a viscous petroleum-containing formation, a casing string having a production opening near its lower portion positioned in said production well, a production flow line in the said casing string extending from a position adjacent said production opening to the earth's surface, a tubular member into said casing string forming a closed-loop flow path from the earth's surface to the lower portion of said formation and back to the earth's surface, a source of hot fluid, conduit means connecting said source of hot fluid to said closed-loop flow path for circulation therethrough to heat the viscous petroleum in said formation adjacent at least a portion of said production well to form a first potential passageway for fluid flow through said formation, a plurality of injection wells linearly spaced apart from said production well and communicating with the upper portion of said formation, the first of said injection wells positioned for injection of hot drive fluid into said first potential passageway for fluid flow in said formation and the remaining injection wells linearly spaced apart from said first injection well and each other at least a distance equal to the distance between said production well and said first injection well, a source of hot drive fluid, conduit means connecting said source of hot drive fluid to said injection wells and valve means on said conduit means for selectively controlling flow of hot drive fluid to said injection wells.

6. The system of claim 5 where the source of hot fluid is a source of steam.

7. The system of claim 6 where the source of hot drive fluid is a source of steam.

8. The system of claim 5 where the source of hot drive fluid is a source of steam.

* * * * *